US007107960B1

(12) United States Patent
Ursu et al.

(10) Patent No.: US 7,107,960 B1
(45) Date of Patent: Sep. 19, 2006

(54) STARTER ASSIST DEVICE FOR AN ENGINE

(75) Inventors: Dan S Ursu, Windsor (CA); John W Potts, Windsor (CA)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 11/316,583

(22) Filed: Dec. 22, 2005

(51) Int. Cl.
*F02N 5/02* (2006.01)

(52) U.S. Cl. ..... 123/185.9; 290/1 E

(58) Field of Classification Search ..... 123/185.1, 123/185.8, 185.9, 185.11, 185.14; 290/1 E
See application file for complete search history.

(56) References Cited

U.S. PATENT DOCUMENTS 743,637 A * 11/1903 Graham et al. ..... 123/185.1
5,132,604 A * 7/1992 Shimane et al. ..... 322/10
6,230,678 B1 5/2001 Gracyalny et al.
6,260,529 B1 7/2001 Gracyalny et al.
6,263,852 B1 7/2001 Gracyalny et al.
6,311,663 B1 11/2001 Gracyalny et al.
6,325,036 B1 12/2001 Gracyalny et al.
6,386,169 B1 5/2002 Gracyalny et al.
6,397,808 B1 * 6/2002 Tanaka et al. ..... 123/179.25
6,595,176 B1 7/2003 Poehlman et al.
6,615,787 B1 9/2003 Gracyalny
6,622,683 B1 9/2003 Gracyalny et al.
6,647,942 B1 11/2003 Poehlman et al.
7,021,271 B1 * 4/2006 Kitamura et al. ..... 123/198 R

* cited by examiner

*Primary Examiner*—Stephen K. Cronin
*Assistant Examiner*—Arnold Castro
(74) *Attorney, Agent, or Firm*—Thomas A. Jurecko

(57) ABSTRACT

A starter assist device for an engine has a first rotatable member for rotating a shaft of the engine in a starting direction. The starter assist device also has a second rotatable member arranged to rotate relative to the first rotatable member in a non-starting direction, and further arranged to rotate in conjunction with the first rotatable member in the starting direction. The starter assist device includes an energy transfer assembly having a torque supply for rotating the second rotatable member in the non-starting direction and an energy storage mechanism arranged to alternately store and release a quantity of energy used when rotating the second rotatable member in the non-starting direction. The energy storage mechanism is arranged to release the quantity of energy to rotate the second rotatable member in the starting direction, thereby causing the first rotatable member to rotate the shaft of the engine.

18 Claims, 7 Drawing Sheets

FIG - 1
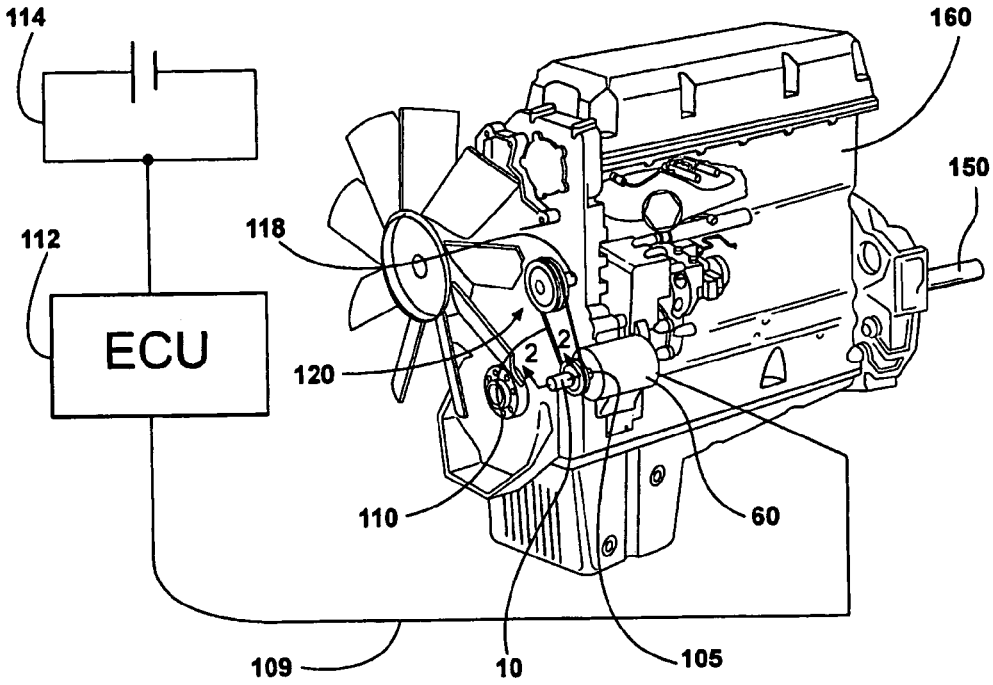
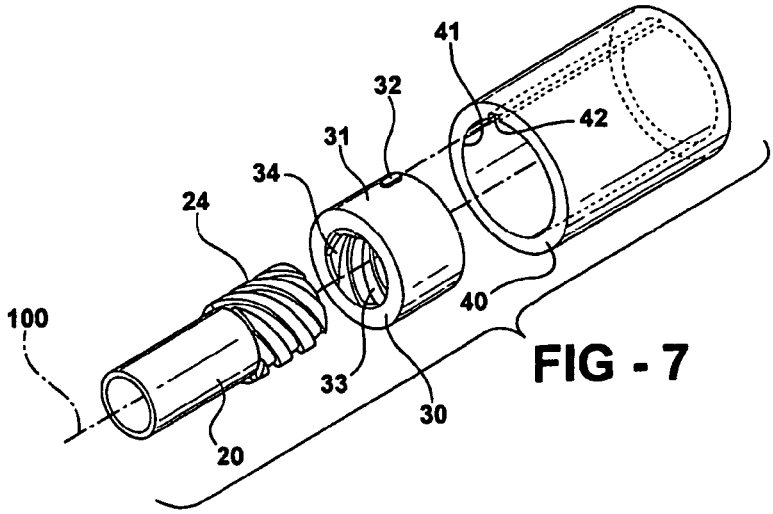
FIG - 7

STARTER ASSIST DEVICE FOR AN ENGINE

FIELD OF THE INVENTION

The present invention relates generally to a starter assist device for an engine.

BACKGROUND OF THE INVENTION

Engines are traditionally started (or "fired") by a starter motor which converts electrical energy provided by a battery into mechanical energy. This mechanical energy turns the engine until a combustion process within a plurality of cylinders is initiated to provide energy so that the engine can sustain rotation under its own power. This process was generally considered sufficient. However, newer engine management systems demonstrate a desire to shut off the engine when a vehicle comes to a complete stop, and to restart the engine when an operator indicates that forward movement is again desired. In such an application, it is desirable to fire an engine rapidly. A traditional starter motor typically provides insufficient energy to accomplish this goal.

Thus, there exists a need for a starter assist device capable of overcoming these and other disadvantages.

SUMMARY OF THE INVENTION

Accordingly, one aspect of the present invention is to provide a starter assist device for an engine. The device comprises a first rotatable member for rotating a shaft of the engine in a starting direction, and a second rotatable member arranged to rotate relative to the first rotatable member in a non-starting direction. The second rotatable member is further arranged to rotate in conjunction with the first rotatable member in the starting direction. The device further comprises an energy transfer assembly including a torque supply for rotating the second rotatable member in the non-starting direction. The energy transfer assembly further includes an energy storage mechanism arranged to alternately store and release a quantity of energy used when rotating the second rotatable member in the non-starting direction. The energy storage mechanism is arranged to release the quantity of energy to rotate the second rotatable member in the starting direction, thereby causing the first rotatable member to rotate the shaft of the engine in the starting direction. The quantity of energy released through the first rotatable member and the second rotatable member is arranged to assist a starter in starting the engine by providing an additional starting torque to the shaft of the engine for at least a portion of a revolution.

According to another aspect of the present invention, the second rotatable member has a first portion and a second portion. The first portion is arranged to rotate in the starting direction and is further arranged to translate relative to the second portion along an axis of translation between a rest position and a wound position. The axis of translation provides an axis about which the first and second portions rotate. The first portion is arranged to translate relative to the second portion from the rest position to the wound position when the second portion is rotated in the non-starting direction. The first portion is further arranged to rotate with the first rotatable member in the starting direction when translating from the wound position to the rest position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 1 shows a block diagram of the a system having a starter assist device according to an exemplary embodiment of the present invention;

FIG. 7 shows an exploded isometric view of a keyway coupling according to the exemplary embodiment of the present invention.

DETAILED DESCRIPTION OF THE EXEMPLARY EMBODIMENTS

Figure 2:
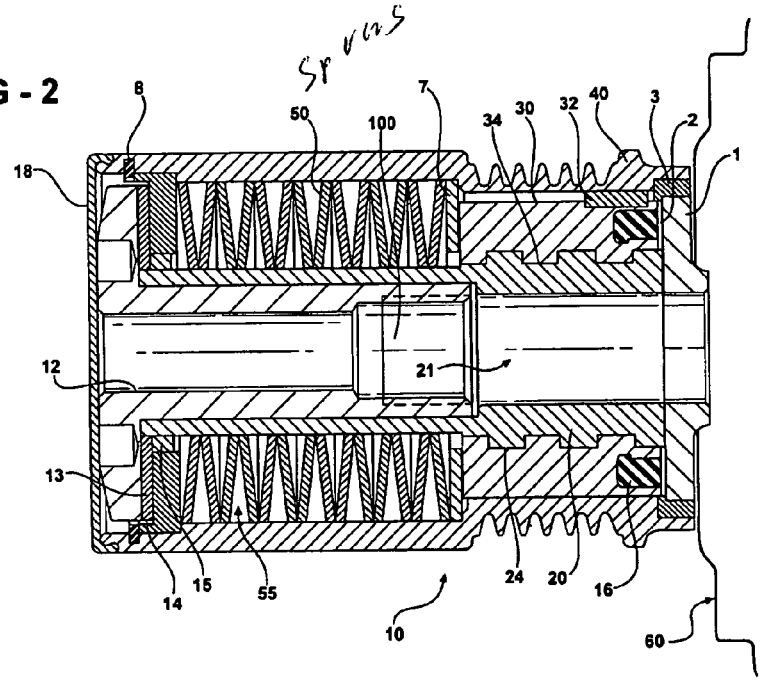
FIG. 2 shows a sectional view of the exemplary embodiment of the starter assist device in isolation taken across line 2—2 of FIG. 1.

Referring to FIG. 1, a starter assist device 10 for assisting a starter 60 of an engine 160 is shown. According to an exemplary embodiment, the starter 60, such as a combination starter/alternator, is connected via an electrical coupling 109 to an engine control unit 112 and a battery 114, and also connected via a rotatable coupling 105 to the starter assist device 10. The starter 60 is also connected via a rotatable coupling 110 to a shaft 118 of the engine 160. The shaft 118 and rotatable coupling 110 may include an engine accessory drive belt arrangement 120.

Referring to FIG. 2, the starter assist device 10 is shown having a first rotatable member 40, and a second rotatable member 21. Further, the starter assist device 10 is coupled to the starter 60 through the second rotatable member 21. The starter assist device 10 is shown having a ball bearing plate 1 adjacent the starter 60. The first rotatable member 40 is coupled to a rear radial bearing 3 with a rear thrust washer 2 positioned between the rear radial bearing 3 and the ball bearing plate 1. The second rotatable member 21 is positioned radially inward from the first rotatable member 40 and adjacent the rear radial bearing 3 at one end, and adjacent a washer 7 and an energy storage mechanism 55 at the other end. The energy storage mechanism 55 is coupled to a front radial bearing 15, a second washer 13 and a retaining ring 8 at an end opposite the washer 7. The starter assist device 10 is covered at an end opposite the starter 60 by a protective cover 18. A starter shaft nut 12 is positioned between the protective cover 18 and the retaining ring 8 and retains the starter assist device 10 to the second rotatable member 21.

Referring to FIGS. 1 and 2, according to the exemplary embodiment, the first rotatable member comprises a pulley 40 arranged to rotate a shaft, such as the shaft 118 of the accessory drive belt arrangement 120, in a starting direction. The second rotatable member 21 is arranged to rotate relative to the first rotatable member 40 in a non-starting direction, and further arranged to rotate with the first rotatable member 40 in a starting direction. According to a first aspect, the starting direction comprises a clockwise direction and the non-starting direction comprises a counter-clockwise direction. According to a second aspect, however, the starting direction comprises a counter-clockwise direction and the non-starting direction comprises a clockwise direction.

Figure 4:
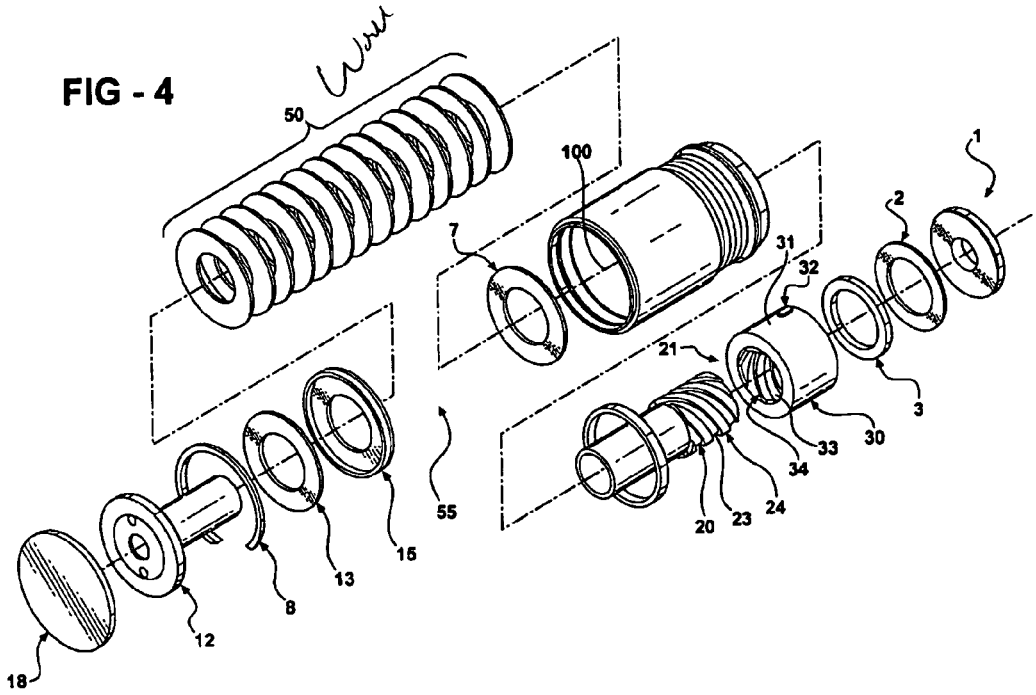
FIG. 4 shows an exploded isometric view of the starter assist device for assisting a starter in isolation according to the exemplary embodiment of the present invention.
Figure 5:
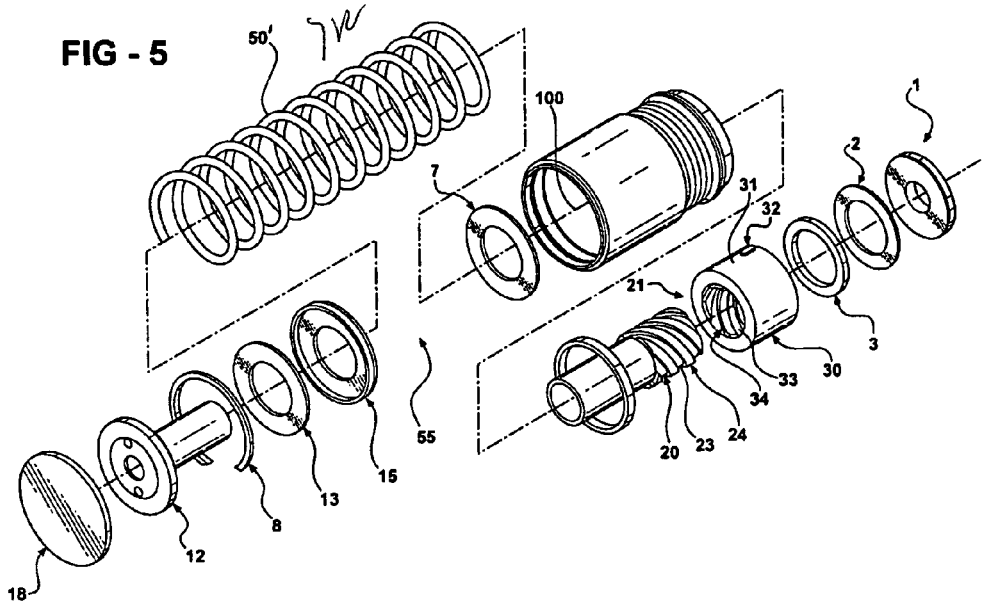
FIG. 5 shows an exploded isometric view of the starter assist device in isolation providing a first alternate elastic element.
Figure 6:
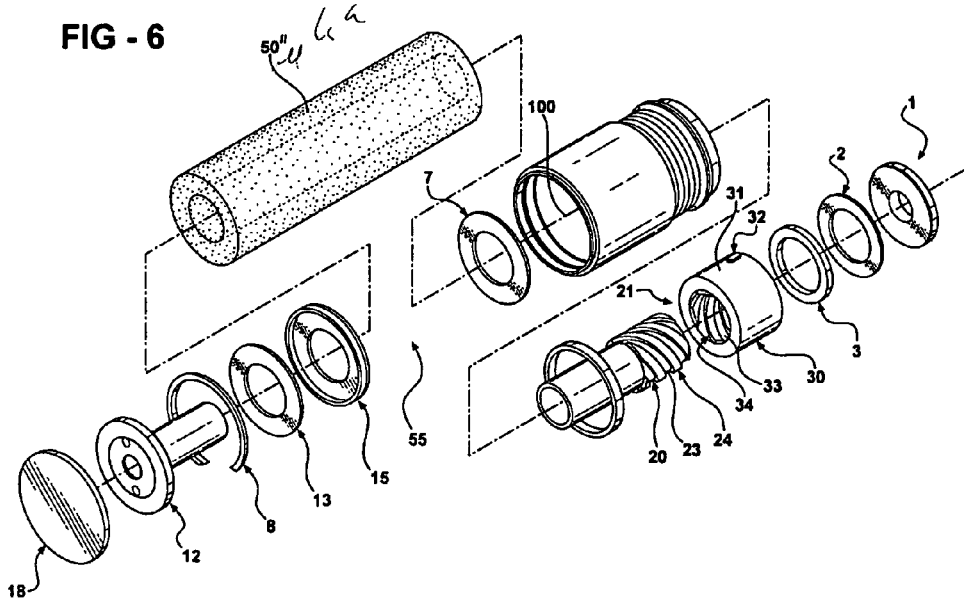
FIG. 6 shows an exploded isometric view of the starter assist device in isolation providing a second alternate elastic element.

The starter assist device 10 is further shown having an energy transfer assembly including a torque supply, such as starter 60, for rotating the second rotatable member 21 in the non-starting direction. The energy transfer assembly further includes an energy storage mechanism 55 arranged to alternately store and release a quantity of energy provided by the starter 60. The energy storage mechanism 55 further includes an elastic element 50 arranged to store the quantity of energy when the second rotatable member 21 is rotated in the non-starting direction, and arrange to release the quantity of energy to rotate the first and second rotatable members 40, 21 in the starting direction. Referring to FIG. 4, according to the exemplary embodiment, the elastic element comprises a plurality of Belleville washers 50. However, a first alternate elastic element comprises a spring 50', as shown in FIG. 5. A second alternate elastic element comprises a rubber element 50", as shown in FIG. 6.

Referring to FIG. 4, the second rotatable member 21 and the energy storage mechanism 55 are shown in an exploded isometric view. According to the exemplary embodiment, the second rotatable member 21 comprises a first portion 30, such as a sleeve, and a second portion 20, such as a rotatable shaft. The sleeve 30 has an inner surface 33 positioned radially inward from an outer surface 31, with a thread 34 disposed along the inner surface 33 and a catch 32 positioned on the outer surface 31. The rotatable shaft 20 has a thread 24 disposed along an outer surface 23 arranged to engage the thread 34 on the inner surface 33 of the sleeve 30.

Figure 3:
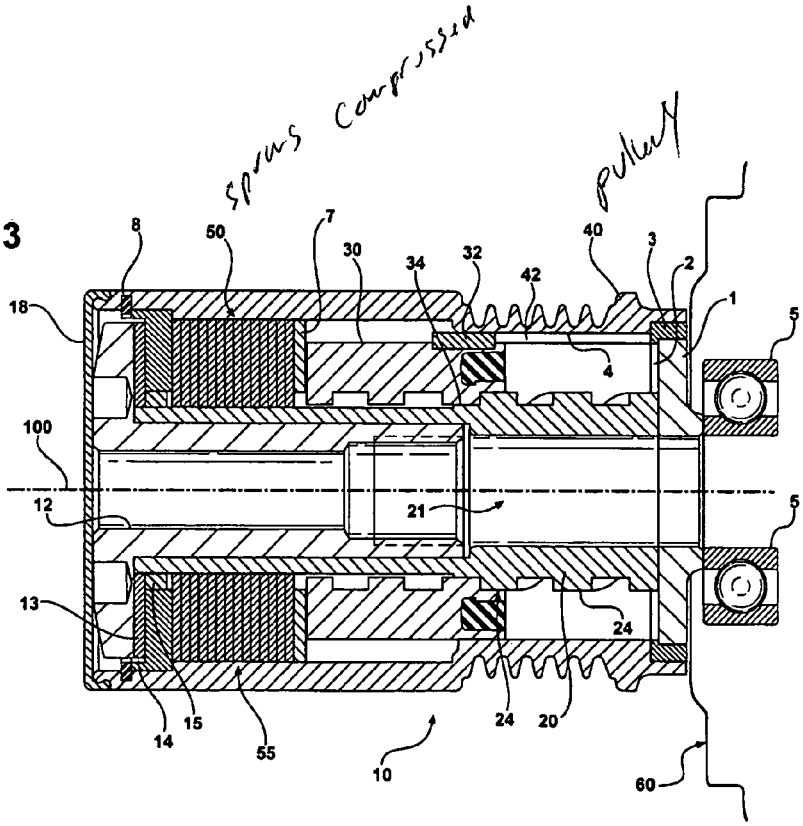
FIG. 3 shows a sectional view of the exemplary embodiment of the starter assist device in isolation after being rotated approximately 150 degrees taken across a line similar to 2—2 of FIG. 1.

Referring to FIGS. 2–3, the threads 24, 34 are arranged to translate the sleeve 30 along an axis of translation 100 relative to the pulley 40 from a rest position (shown in FIG. 2) to a wound position (shown in FIG. 3) when the rotatable shaft 20 rotates about the axis of translation 100 in the non-starting direction. As the sleeve 30 translates down the rotatable shaft 20, the sleeve 30 pushes against the washer 7 and compresses the plurality of Belleville washers 50. The washers 50 store the quantity of energy used by the starter 60 in rotating the rotatable shaft 20 and translating the sleeve 30. According to a third aspect, the sleeve 30 reaches the wound position when the rotatable shaft has rotated approximately 150 degrees. According to a fourth aspect, the sleeve 30 reaches the wound position when the rotatable shaft has rotated approximately 10 degrees. According to a fifth aspect, the sleeve 30 reaches the wound position when the rotatable shaft has rotated approximately 180 degrees.

Referring to FIGS. 1–3, once the energy is released from the washers 50, and the washers 50 expand, the rotatable shaft 20 remains stationary as the sleeve 30 winds back up the threads 24, 34 from the wound position to the rest position. The catch 32 positioned on the outer surface 31 of the sleeve 30 is arranged to engage a corresponding catch 42 positioned on an inner surface 41 of the pulley 40. This causes the pulley 40 to rotate in the starting direction, turning the shaft 118 of the engine 160 in the starting direction. According to the exemplary embodiment, the quantity of energy provided by the starter assist device 10 to the engine 160 is in addition to a starting torque being provided by the starter 60. This additional torque assists the starter 60 for at least a portion of a revolution of the engine, with the starter 60 thereafter providing sufficient torque to continue rotating the engine 160 until it is started. Once the engine 160 is started, a combustion sequence takes place within the engine 160 to create a torque which turns the accessory drive belt 120 and a crankshaft 150. The starter assist device 10 remains engaged with the shaft 118 and continues to rotate along with the shaft 118 and the accessory belt drive 120.

Referring to FIG. 7, the first and second rotatable members 40, 21 are shown in isolation in an exploded isometric view. According to the exemplary embodiment, the sleeve 30 and the pulley 40 are joined via a keyway coupling. The catch 32 positioned on the outer surface 31 of the sleeve 30 may comprise a key, while the corresponding catch 42 positioned on the inner surface 41 of the pulley 40 may comprise a keyway. The key 32 is arranged to slide within the keyway 42, relative to the pulley 40 when the sleeve is translated from the rest position to the wound position. The key 32 is further arranged to engage the keyway 42 when the sleeve winds back up the rotatable shaft 20 from the wound position to the rest position, thereby causing the pulley 40 to rotate in the starting direction. While the exemplary embodiment shows the key 32 being positioned on the sleeve and the keyway 42 being positioned on the pulley, it should be understood that the positions could be switched with no difference in result.

Figure 8:
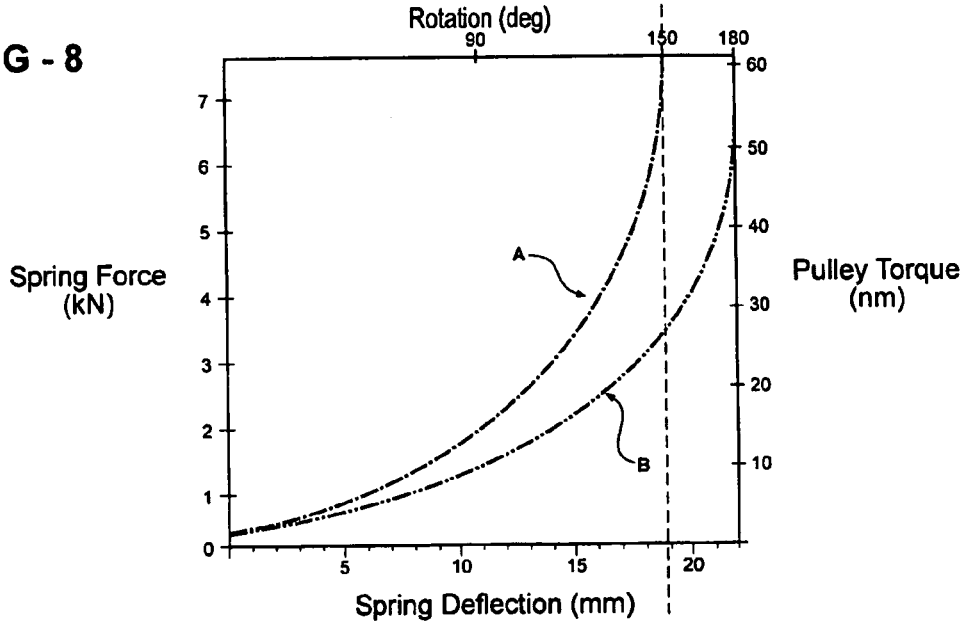
FIG. 8 shows a spring force diagram of two exemplary aspects according to the present invention.

Referring to FIG. 8, a spring force diagram is provided showing resulting spring force and pulley torque as a function of spring deflection and degree of rotation. According to curve A, the spring generates approximately 7 kN of force, equating to approximately 60 N-m of pulley torque at a rotation of approximately 150 degrees and a spring deflection of approximately 18.5 mm. According to curve B, the spring generates similar amounts of spring force and torque at a rotation of approximately 180 degrees and a spring deflection of approximately 21.5 mm.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A starter assist device for an engine comprising:

a first rotatable member for rotating a shaft of the engine in a starting direction;

a second rotatable member arranged to rotate relative to the first rotatable member in a non-starting direction, and further arranged to rotate in conjunction with the first rotatable member in the starting direction; and an energy transfer assembly having a torque supply for rotating the second rotatable member in the non-starting direction, the energy transfer assembly further including an energy storage mechanism arranged to alternately store and release a quantity of energy used when rotating the second rotatable member in the non-starting direction, the energy storage mechanism arranged to release the quantity of energy to rotate the second rotatable member in the starting direction, thereby causing the first rotatable member to rotate the shaft of the engine in the starting direction;

wherein the quantity of energy released through the first rotatable member and the second rotatable member is arranged to assist a starter in starting the engine by providing an additional starting torque to the shaft of the engine for at least a portion of a revolution.

2. The device of claim 1 wherein the starter provides both a starting torque to the engine and the torque supply of the energy transfer assembly, the starter being further assisted in starting the engine by the additional starting torque.

3. The device of claim 1 wherein the starter comprises a combination starter-alternator.

4. The device of claim 1 wherein the shaft of the engine comprises a shaft positioned within an accessory drive belt arrangement coupled to the engine.

5. The device of claim 1 wherein the quantity of energy is arranged to turn the shaft of the engine for at least 10 degrees.

6. The device of claim 1 wherein the quantity of energy is arranged to turn the shaft of the engine for at least 145 degrees.

7. The device of claim 1 wherein the second rotatable member comprises a sleeve and a rotatable shaft, the sleeve having an outer surface positioned radially outward from an inner surface, the sleeve including a thread disposed along the inner surface and arranged to translate along an axis of translation between a rest position and a wound position, the sleeve further arranged to rotate about the axis of translation, the rotatable shaft arranged to be coupled to the torque supply and including a thread disposed on an outer surface of the rotatable shaft arranged to engage the inner surface of the sleeve, the thread arranged to translate the sleeve from the rest position to the wound position by rotating in the non-starting direction, wherein a catch positioned on the outer surface of the sleeve is arranged to engage a corresponding catch positioned on an inner surface of the first rotatable member for rotating the first rotatable member in the starting direction when the sleeve rotates about the axis of translation and translates from the wound position to the rest position.

8. The device of claim 7 further including a keyway coupling for coupling the sleeve to the first rotatable member wherein the catch positioned on the outer surface of the sleeve comprises one of a key or a keyway and the corresponding catch positioned on the inner surface of the first rotatable member comprises the other of the key or the keyway, the key being arranged to slide relative to the keyway when the sleeve is translated from the rest position to the wound position, and the key further arranged to engage and rotate the pulley in the starting direction when the sleeve rotates about the axis of translation and translates from the wound position to the rest position.

9. The device of claim 1 further including:

the first rotatable member comprising a pulley having an outer surface positioned radially outward from an inner surface, the outer surface of the pulley arranged to engage the shaft of the engine;

the second rotatable member comprising a sleeve and a rotatable shaft, the sleeve having an outer surface positioned radially outward from an inner surface, the sleeve including a thread disposed along the inner surface and arranged to translate along an axis of translation between a rest position and a wound position, the sleeve further arranged to rotate about the axis of translation, the rotatable shaft arranged to be coupled to the torque supply, and including a thread disposed on an outer surface of the rotatable shaft arranged to engage the inner surface of the sleeve, the thread arranged to translate the sleeve from the rest position to the wound position by rotating in the non-starting direction, wherein a catch positioned on the outer surface of the sleeve is arranged to engage a corresponding catch positioned on the inner surface of the pulley for rotating the pulley in the starting direction when the sleeve rotates about the axis of translation and translates from the wound position to the rest position; and the energy storage mechanism arranged to engage the sleeve for storing a quantity of energy from the torque supply when the sleeve is translated from the rest position to the wound position, the energy storage mechanism further arranged to release the quantity of energy through the sleeve to rotate the sleeve about the axis of translation in the starting direction and to transfer the quantity of energy to the pulley;

wherein the quantity of energy released from the energy storage mechanism transfers to the sleeve and the pulley and is arranged to enable the pulley to initiate rotation of the shaft of the engine for at least a portion of revolution, thereby providing the additional starting torque to assist the starter in turning the shaft of the engine for at least a portion of a revolution, the starting torque provided by the starter thereafter being sufficient to start the engine.

10. The device of claim 9 further including a keyway coupling for coupling the sleeve to the pulley wherein the catch positioned on the outer surface of the sleeve comprises one of a key or a keyway and the corresponding catch positioned on the inner surface of the pulley comprises a the other of the key or the keyway, the key arranged to slide relative to the keyway when the sleeve is translated from the rest position to the wound position, and the key further arranged to engage and rotate the pulley when the sleeve rotates in the starting direction about the axis of translation and translates from the wound position to the rest position.

11. The device of claim 10 wherein the sleeve continues rotate with the pulley in the starting direction once the engine has been started, the engine thereafter supplying a torque to turn the pulley.

12. The device of claim 9 wherein the energy storage mechanism includes an elastic element coupled to the sleeve, the elastic element arranged to compress linearly along the axis defined by the direction of translation of the sleeve.

13. The device of claim 12 wherein the elastic element comprises a plurality of Belleville washers.

14. The device of claim 12 wherein the elastic element comprises a rubber element.

15. The device of claim 12 wherein the elastic element comprises a spring.

16. A vehicle comprising:

an engine including a shaft arranged to turn the engine in a starting direction;

a starter coupled to the shaft and arranged to provide a starting torque for starting the engine; and a device for assisting the starter comprising:

a first rotatable member for rotating the shaft in the starting direction;

a second rotatable member having a first portion arranged to rotate in the starting direction and further arranged to translate relative to a second portion along an axis of translation between a rest position and a wound position, the second portion arranged to rotate in the non-starting direction, the axis of translation providing an axis about which the first portion and the second portion of the second rotatable member rotate, the first portion of the second rotatable member being further arranged to translate relative to the second portion from the rest position to the wound position when the second portion of the second rotatable member is rotated in the non-starting direction, and the first portion of the second rotatable member arranged to rotate with the first rotatable member in the starting direction when translating from the wound position to the rest position; and an energy transfer assembly including a torque supply for rotating the second rotatable member in the non-starting direction, the energy transfer assembly further including an energy storage mechanism arranged to alternately store and release a quantity of energy used when rotating the second rotatable member in the non-starting direction, the energy transfer assembly arranged to release the quantity of energy to rotate the second rotatable member in the starting direction, thereby causing the first rotatable member to rotate the shaft of the engine in the starting direction;

wherein the quantity of energy released through the first rotatable member and the second rotatable member is arranged to assist the starter in starting the engine by providing an additional starting torque to the shaft of the engine for at least a portion of a revolution.

17. The vehicle of claim 16 further including:

the first rotatable portion comprising a pulley having an outer surface positioned radially outward from an inner surface, the outer surface of the pulley arranged to engage the shaft of the engine;

the first portion of the second rotatable member comprising a sleeve having an outer surface positioned radially outward from an inner surface, the sleeve including a thread disposed along the inner surface and a catch positioned on the outer surface for selectively engaging a corresponding catch positioned on the inner surface of the pulley, the catch arranged to translate relative to the corresponding catch when the sleeve is translated from the rest position to the wound position, and further arranged to engage the corresponding catch and rotate the pulley when the sleeve rotates in the starting direction about the axis of translation and translates from the wound position to the rest position;

the second portion of the second rotatable member comprising a rotatable shaft arranged to be coupled to the torque supply and including a thread disposed on an outer surface of the rotatable shaft for engaging the inner surface of the sleeve, the rotatable shaft arranged to translate the sleeve from the rest position to the wound position by rotating in the non-starting direction; and the energy storage mechanism arranged to engage the sleeve for storing a quantity of energy from the torque supply when the sleeve is translated from the rest position to the wound position, the energy storage mechanism further arranged to release the quantity of energy through the sleeve to rotate the sleeve in the starting direction about the axis of translation and transfer the quantity of energy to the pulley;

wherein the quantity of energy released from the energy storage mechanism transfers to the sleeve and the pulley and is arranged to enable the pulley to initiate rotation of the shaft of the engine for at least a portion of a revolution, thereby providing the additional starting torque to assist the starter in turning the shaft of the engine for at least a portion of a revolution, the starting torque provided by the starter thereafter being sufficient to start the engine.

18. The vehicle of claim 17 further including a keyway coupling for coupling the sleeve to the pulley wherein the catch positioned on the outer surface of the sleeve comprises one of a key or a keyway and the corresponding catch positioned on the inner surface of the pulley comprises the other of the key or the keyway, the key arranged to slide relative to the keyway when the sleeve is translated from the rest position to the wound position, and the key further arranged to engage and rotate the pulley when the sleeve translates and rotates about the axis of translation in the starting direction.

* * * * *